US008671913B2

(12) United States Patent
Carbonne et al.

(10) Patent No.: US 8,671,913 B2
(45) Date of Patent: Mar. 18, 2014

(54) DETERMINING AND CORRECTING THE PHASING OF THE ANGULAR POSITION OF A FOUR-STROKE INTERNAL COMBUSTION ENGINE WITH INDIRECT INJECTION AND TIME-CONTROLLED SEQUENTIAL REINJECTION/SEQUENTIAL INJECTION CUTOFF

(75) Inventors: Laure Carbonne, Toulouse (FR); Patrick Cremona, Mondouzil (FR); Pierre Zouboff, Toulouse (FR)

(73) Assignee: Continental Automotive France, Toulouse (FR)

( * ) Notice: Subject to any disclaimer, the term of this patent is extended or adjusted under 35 U.S.C. 154(b) by 1140 days.

(21) Appl. No.: 12/602,713

(22) PCT Filed: May 28, 2008

(86) PCT No.: PCT/EP2008/004220

§ 371 (c)(1), (2), (4) Date: Dec. 2, 2009

(87) PCT Pub. No.: WO2008/148485

PCT Pub. Date: Dec. 11, 2008

(65) Prior Publication Data

US 2010/0170478 A1 Jul. 8, 2010

(30) Foreign Application Priority Data

Jun. 4, 2007 (FR) ..... 07 03956

(51) Int. Cl.

| | |
|---|---|
| ***F02M 51/00*** | (2006.01) |
| ***F02D 7/00*** | (2006.01) |
| ***F02B 77/08*** | (2006.01) |
| ***F02D 17/04*** | (2006.01) |
| ***F02M 63/02*** | (2006.01) |

(52) U.S. Cl.
USPC ..... 123/478; 123/198 DB; 123/481

(58) Field of Classification Search
USPC ..... 123/179.4, 198 DB, 198 F, 325, 326, 123/332, 394, 472, 478, 481; 701/112
See application file for complete search history.

(56) References Cited

U.S. PATENT DOCUMENTS 5,425,340 A 6/1995 Petitbon (Continued)

FOREIGN PATENT DOCUMENTS

| | | |
|---|---|---|
| DE | 19844910 | 4/2000 |
| DE | 10120800 | 11/2002 |

(Continued)

OTHER PUBLICATIONS

International Search Report dated Oct. 7, 2008, in PCT application.

*Primary Examiner* — Stephen K Cronin
*Assistant Examiner* — Sizo Vilakazi
(74) *Attorney, Agent, or Firm* — Young & Thompson

(57) ABSTRACT

A method for determining the phasing of the angular position of a four-stroke internal combustion engine with indirect injection and time-controlled sequential reinjection/sequential injection cutoff, characterized in that it includes, with the engine running, the following steps:

Figure 1:
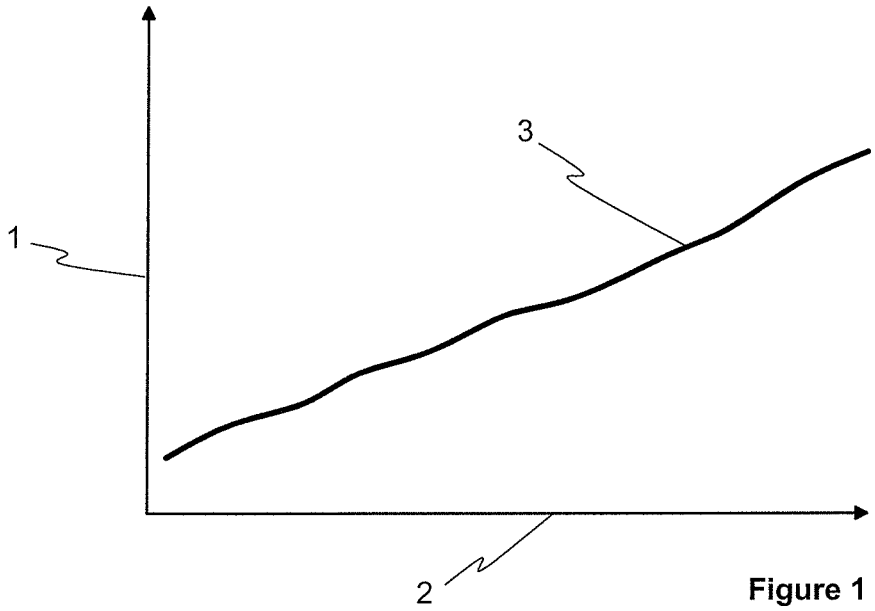

observing the curve (3, 4) of engine speed (1) as a function of time (2) during a phase of sequential reinjection and/or sequential injection cutoff, performed in accordance with the expected oscillations of the transmission, discriminating, according to the shape of the curve (3, 4), a substantially linear shape (3) being indicative of correct phasing, whereas a substantially sinusoidal shape (4) is indicative of incorrect phasing.

12 Claims, 1 Drawing Sheet

(56) References Cited

U.S. PATENT DOCUMENTS

| | | | | |
|---|---|---|---|---|
| 6,283,105 | B1 * | 9/2001 | Kasai | 123/672 |
| 2008/0017173 | A1 * | 1/2008 | Fujii | 123/478 |
| 2010/0250105 | A1 * | 9/2010 | Nagatsuyu et al. | 701/112 |

FOREIGN PATENT DOCUMENTS

| | | | | |
|---|---|---|---|---|
| DE | 19844910 | * | 4/2004 | F02D 41/00 |
| EP | 0 576 334 | | 12/1993 | |
| FR | 2 663 369 | | 12/1991 | |

* cited by examiner

DETERMINING AND CORRECTING THE PHASING OF THE ANGULAR POSITION OF A FOUR-STROKE INTERNAL COMBUSTION ENGINE WITH INDIRECT INJECTION AND TIME-CONTROLLED SEQUENTIAL REINJECTION/SEQUENTIAL INJECTION CUTOFF

The present invention relates to a method for determining and correcting the phasing of the angular position of a four-stroke internal combustion engine with indirect injection and time-controlled sequential reinjection/sequential injection cutoff and to a method for correcting said phasing.

In the field of internal combustion engine management, it is known practice for the various injection commands and, where appropriate, the ignition commands, to be synchronized, for each cylinder, as a function of the angular position of the crankshaft. It is this synchronizing that is commonly known as the "phasing" in the remainder of this document. The angular position of the crankshaft is generally determined by a crankshaft angle position sensor that already exists on an engine, such as, for example, a sensor associated with a toothed target comprising sixty teeth, two of which are eliminated to act as a reference index. However, a four-stroke engine cycle takes place over two revolutions of the crankshaft, and there is therefore an uncertainty of one crankshaft revolution, namely 360°, in the measurement of the angular position.

Under certain conditions detailed later on, an engine may start and run in spite of its phasing being out by 360°. However, such running with the phasing out comes with impaired drivability and increased pollutant emissions.

One statistical method for dealing with this problem of engine phasing is to start the engine with some arbitrary and unknown phasing. This method is unsatisfactory in that it produces 50% of incorrect phasings.

Another method that is the subject of patent FR 2 663 369 is to store the position of the engine when it stops and use this reference for the subsequent restart. This solution is not robust in that any pushing of the vehicle while stationary that causes the crankshaft to turn may alter said reference.

Another way of solving the problem is to use a camshaft angular position sensor. The angular position of the camshaft, which synchronously effects one revolution per engine cycle (or, to put it another way, one revolution per two crankshaft revolutions) makes it possible to determine the angular position of the engine between 0 and 360° CAM or between 0 and 720° CRK, without any problem with phasing. By convention, and this is the common convention used in the field, degrees CAM are measured for the camshaft (CAM being the abbreviation for the English term camshaft) and degrees CRK are measured for the crankshaft (CRK being the abbreviation for the English word crankshaft). Unless specified otherwise, degrees are assumed to be degrees CRK. Such a sensor measuring the angular position of the camshaft, specifically installed for the application, entails an additional cost and may also be subject to failure. The invention proposes to avoid this additional cost or to reduce the effects of such failure.

The invention relates to a method for determining the phasing of the angular position of a four-stroke internal combustion engine with indirect injection and time-controlled sequential reinjection/sequential injection cutoff, characterized in that it comprises, with the engine running, the following steps:

observing the curve of engine speed as a function of time during a phase of sequential reinjection and/or sequential injection cutoff, performed in accordance with the expected oscillations of the transmission, discriminating, according to the shape of said curve, a substantially linear shape being indicative of correct phasing, whereas a substantially sinusoidal shape is indicative of incorrect phasing.

According to another feature of the invention, the discrimination is performed by thresholding the variation in amplitude of said curve.

According to another feature of the invention, the discrimination is performed by frequency analysis of said curve.

Advantageously, in the case of a spark-ignition internal combustion engine, an additional step of confirming incorrect phasing by measuring the ignition advance correction is used. If it is found that using large ignition retard values is ineffective at making the shape of said curve linear, then the diagnosis of incorrect phasing is confirmed.

The invention also relates to a method for correcting the phasing of the angular position of an internal combustion engine with indirect injection and time-controlled sequential reinjection/sequential injection cutoff, comprising, with the engine running, the following steps: determining the phasing from the angular position of said engine using the above method; if the phasing is correct, the method is terminated; if the phasing is incorrect, resynchronizing the engine.

According to another feature of the invention, following resynchronization, a further determining of the phasing of the angular position of said engine is performed using the same method.

One advantage of the invention is that it makes it possible to save on having a camshaft angular position sensor.

Another advantage of the invention is that it allows the engine to be run with the correct phasing, limiting pollutant emissions and improving drivability.

Figure 2:
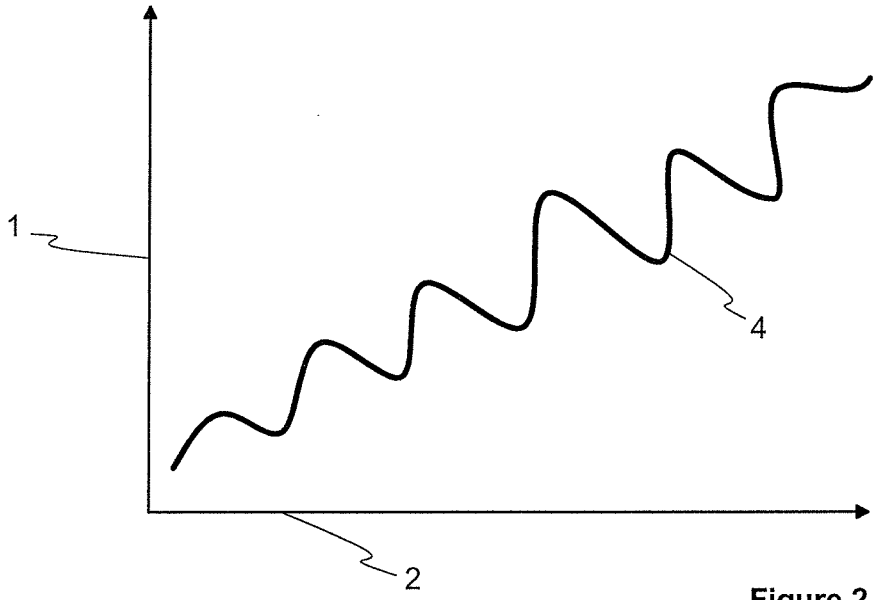

Further features, details and advantages of the invention will become more clearly apparent from the detailed description given hereinafter by way of indication in conjunction with the drawings in which:

FIG. 1 represents a curve of engine speed as a function of time for an indirect injection engine running with correct phasing, FIG. 2 represents a curve of engine speed as a function of time for an indirect injection engine running with incorrect phasing.

The invention relates to an assistance for the management of an indirect-injection four-stroke internal combustion engine. In such an engine, the key event for engine management is the injection of fuel. The engine management determines, for each cylinder, the instant at which the injection of fuel is to take place as a function of the angular position of the crankshaft. When this angular position is determined by a crankshaft angular position sensor, it has been shown above that a phasing error of 360° CRK may be committed. In the case of an indirect-injection engine, injection is performed into the intake tract (also termed the intake manifold) upstream of the intake valve. When the phasing is correct, said injection is performed shortly before the intake valve opens, allowing the mixture to access the combustion chamber. If the phasing is incorrect, the injected mixture remains trapped in the intake manifold, behind the valve that remains closed for one crankshaft revolution (360° CRK) and finally, 360° CRK later, enters the combustion chamber during the "out-of-phase" opening of the intake valve. The cycle is thus retarded by 360° overall but the engine runs nonetheless.

In the case of a direct injection engine, the engine will not run when the phasing is incorrect and so the problem does not arise.

The invention applies to any indirect-injection engine, whether this is a gasoline engine or a diesel engine. In order for the problem of determining the phasing to arise it is, however, necessary for the engine to actually start, even with incorrect phasing. For that, the fuel/oxidant mixture needs to encounter a means of ignition as it enters the combustion chamber. It always does so in a diesel engine in which ignition occurs spontaneously at top dead center as a result of compression. It also does so in a gasoline engine in a first scenario in which ignition is triggered, independently of the injection, directly by the camshaft. Again it does so for a gasoline engine in a second scenario in which the ignition is said to be semistatic (ignition is triggered on each crankshaft revolution, namely twice per engine cycle). In this last instance, two opposed cylinders are advantageously ignited simultaneously.

An internal combustion engine, which in the conventional way comprises several cylinders, finds its crankshaft driven discontinuously as a result of the successive combustions of each of the cylinders. In the case of an engine running with the correct phasing, combustion occurs just before the deceleration caused by the lash in the transmission and thus compensates for any lack of smoothness that may arise in said transmission. This contributes to producing good drivability. In an engine running with incorrect phasing, this drivability is impaired.

Nonetheless, the vast majority of engines, in order to improve drivability still further, are fitted with what is known as a time-controlled sequential reinjection and sequential cutoff device. An engine equipped with such a device works as follows.

The engine management device cuts off the injection of fuel as soon as the throttle is backed off. This cutoff is not, however, in practice sudden, otherwise there would be jerkiness in the transmission. The injection is therefore cut off in a precise order. This order is established by testing and is dependent on the engine speed, on the applied load, on the type of engine, and on the transmission ratio used (because this jerkiness arises out of oscillations in the transmission). For each type of engine and associated transmission, special testing can be used to establish a map which will be stored in order to be applied to the production models.

Similarly, following a sequential injection cutoff, it is necessary to carry out a controlled sequential reinjection in order to meet the needs of the driver of the vehicle as he opens the throttle. Once again, testing is used to establish maps in order to optimize the instants of injection as a function of the parameters listed above.

It is in such a scenario, that is to say for an indirect-injection engine fitted with a time-controlled sequential reinjection and sequential injection cutoff device that the invention is implemented. It applies only to this type of configuration. In such a scenario, the abovementioned jerkiness that the engine management device is to attempt to eliminate using the maps in its possession will not be able to be eliminated. Thus, when the engine is incorrectly phased, that is to say when there is an error of 360° CRK, the combustion events take place with a time shift with respect to the timings planned by the engine management system in the sequential reinjection or sequential injection cutoff phases. Because combustion events are no longer in tune with the oscillations of the transmission, jerkiness or lack of smoothness is perceptible to the occupants of the vehicle and drivability is impaired thereby. This jerkiness also produces a series of clearly perceivable accelerations and decelerations in engine speed.

The method according to the invention puts this observation to good use by studying the engine speed signal. The method assumes that the engine is already running, having started with unknown phasing. Failing that, a step preliminary to the method may start the engine. The method comprises a first step of observing the curve 3, 4 of engine speed 1 as a function of time 2. FIGS. 1 and 2 show illustrative examples of such curves. In the two figures, the axis 2 represents time, or, and this amounts to the same, an angular position of the engine, while the axis 1 represents engine speed. Engine speed is conventionally obtained by processing the signal from the crankshaft angular position sensor.

FIG. 1 represents a curve 3 of engine speed 1 in the case of correct phasing. FIG. 2 represents a curve 4 corresponding to the engine speed 1 in the case of incorrect phasing, all the other parameters remaining identical. It may be seen that curve 3 is substantially linear whereas curve 4 appears more disrupted.

During a second step, discrimination is carried out according to the shape of said curve 3, 4. A substantially linear shape 3 of the type of that in FIG. 1 is indicative of correct phasing, whereas a substantially sinusoidal shape 4 of the type of that in FIG. 2 is indicative of incorrect phasing.

According to a first embodiment, discrimination is performed by thresholding the variation in amplitude of said curve 3, 4. Subtracting the continuous mean value beforehand makes it possible to get around low-frequency variations. Thus, in the examples of FIGS. 1 and 2, the upward gradient corresponds to an increase in speed. With this variation eliminated, it is possible to determine a variation in amplitude. This variation is practically zero in the case of curve 3 which displays little by way of oscillations. It is more pronounced in the case of curve 4. This pronounced nature is indicative of the disruption and oscillations of the curve 4 of FIG. 2 corresponding to incorrect phasing. Thresholding then makes it possible to distinguish correct phasing from incorrect phasing.

Still other methods are conceivable, for example frequency analysis methods. Because the main frequency of oscillation of the disrupted curve 4 is directly linked with the operation of the engine cycle it is readily detectable and reveals a line in a frequency spectrum. The significant presence of such a line in spectrum enables incorrect phasing to be determined.

The diagnosis of incorrect phasing may be confirmed using data accessible in the engine management device in the case of a spark-ignition engine. Specifically, when the engine management system observes jerkiness in the engine speed during sequential reinjection or sequential injection cutoff phases, one means usually implemented in an attempt to reduce or even eliminate said jerkiness is to modify the instant of ignition of the fuel/oxidant mixture (an action known as ignition advance management). However, in the case of an engine with incorrect phasing the jerkiness will continue to be present even after large-scale modifications to the ignition advance (in this particular instance huge reductions in the ignition advance). This may serve to confirm the initial diagnosis where applicable.

The aforementioned method for determining the phasing of the angular position can be applied to the correcting of said phasing. The engine is assumed to be running. Failing that, the method may begin by a command to start the engine. A correction method such as this comprises a first step of determining the phasing of the angular position of the engine using one of the embodiments of the aforementioned method. There are then two possible scenarios: if the phasing is correct, no correction is needed and the correction method is terminated. If not, if the phasing is incorrect, the engine is resynchronized.

Resynchronizing of the engine takes place, in the engine management system, by changing the angular references. All the references are shifted by 360°. Thus, the control of injections and, where applicable, of ignitions subsequent to resynchronization, is correctly phased.

According to an optional embodiment, it is possible, following resynchronization, to determine the phasing of the angular position of said engine again using the same determination method. This makes it possible to verify and confirm that all the determining and resynchronizing operations have been carried out correctly.

The invention claimed is:

1. A method for determining the phasing of the angular position of a four-stroke internal combustion engine with indirect injection and time-controlled sequential reinjection and sequential injection cutoff, comprising the steps of:

with the engine running in a moving vehicle:

i) observing the curve (3, 4) of engine speed (1) as a function of time (2) during a phase of sequential reinjection and/or sequential injection cutoff, performed in accordance with the expected oscillations of the transmission, and ii) discriminating, according to the shape of said curve (3, 4), a substantially linear shape (3) being indicative of correct phasing, whereas a substantially sinusoidal shape (4) is indicative of incorrect phasing.

2. The method for determining the phasing as claimed in claim 1, in which the discrimination is performed by thresholding the variation in amplitude of said curve (3, 4).

3. The method of determining the phasing as claimed in claim 1, in which the discrimination is performed by frequency analysis of said curve (3, 4).

4. The method of determining the phasing as claimed in claim 1, applied to a spark-ignition internal combustion engine, comprising the further step of confirming incorrect phasing by measuring the ignition advance correction used.

5. The method of determining the phasing as claimed in claim 4, wherein, when using large ignition retard values is found to be ineffective at making the shape of said curve (3, 4) linear (3), then the diagnosis of incorrect phasing is confirmed.

6. A method for correcting the phasing of the angular position of an internal combustion engine with indirect injection and time-controlled sequential reinjection and sequential injection cutoff, comprising the steps of:

with the engine running in a moving vehicle, determining the phasing from the angular position of said engine using the sub steps of i) observing the curve (3, 4) of engine speed (1) as a function of time (2) during a phase of sequential reinjection and/or sequential injection cutoff, performed in accordance with the expected oscillations of the transmission, and ii) discriminating, according to the shape of said curve (3, 4), a substantially linear shape (3) being indicative of correct phasing, whereas a substantially sinusoidal shape (4) is indicative of incorrect phasing;

when the phasing is correct, the method is terminated; and when the phasing is incorrect, resynchronizing the engine.

7. The method for correcting as claimed in claim 6, further comprising, following resynchronization, a further determining of the phasing of the angular position of said engine.

8. The method of determining the phasing as claimed in claim 2 applied to a spark-ignition internal combustion engine, comprising the further step of confirming incorrect phasing by measuring the ignition advance correction used.

9. The method of determining the phasing as claimed in claim 3, applied to a spark-ignition internal combustion engine, comprising the further step of confirming incorrect phasing by measuring the ignition advance correction used.

10. The method of determining the phasing as claimed in claim 8, wherein, when using large ignition retard values is found to be ineffective at making the shape of said curve (3, 4) linear (3), then the diagnosis of incorrect phasing is confirmed.

11. The method of determining the phasing as claimed in claim 9, wherein, when using large ignition retard values is found to be ineffective at making the shape of said curve (3, 4) linear (3), then the diagnosis of incorrect phasing is confirmed.

12. The method for correcting as claimed in claim 6, applied to a spark-ignition internal combustion engine, comprising the further step of confirming incorrect phasing by measuring the ignition advance correction used.

* * * * *

UNITED STATES PATENT AND TRADEMARK OFFICE

CERTIFICATE OF CORRECTION

PATENT NO. : 8,671,913 B2
APPLICATION NO. : 12/602713
DATED : March 18, 2014
INVENTOR(S) : Carbonne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1141 days.

Signed and Sealed this
Twenty-ninth Day of September, 2015

Michelle K. Lee

Michelle K. Lee
*Director of the United States Patent and Trademark Office*